US007416270B2

(12) United States Patent
Sugahara

(10) Patent No.: US 7,416,270 B2
(45) Date of Patent: Aug. 26, 2008

(54) INK JET HEAD, METHOD FOR PRODUCING INK JET HEAD, AND DISCHARGE DIRECTION CORRECTING METHOD FOR INK JET HEAD

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 263 days.

(21) Appl. No.: 11/087,049

(22) Filed: Mar. 23, 2005

(65) Prior Publication Data

US 2005/0219311 A1 Oct. 6, 2005

(30) Foreign Application Priority Data

Mar. 31, 2004 (JP) ..... 2004-102196

(51) Int. Cl.
*B41J 29/393* (2006.01)

(52) U.S. Cl. ..... 347/19; 347/71; 347/40; 347/47

(58) Field of Classification Search ..... 347/67–72, 347/40, 43, 65, 66, 47, 49, 19
See application file for complete search history.

(56) References Cited

U.S. PATENT DOCUMENTS 5,560,090 A * 10/1996 Komakine et al. ..... 29/25.35
5,650,806 A * 7/1997 Denne ..... 347/20
6,074,046 A * 6/2000 Wen ..... 347/68
6,776,469 B2 * 8/2004 Nozawa ..... 347/14
2003/0202045 A1 * 10/2003 Torgerson et al. ..... 347/43
2003/0202051 A1 10/2003 Ito et al.
2003/0222946 A1 * 12/2003 Ito ..... 347/68
2004/0012649 A1 * 1/2004 Eguchi et al. ..... 347/20

FOREIGN PATENT DOCUMENTS

JP A 2003-326712 11/2003

* cited by examiner

*Primary Examiner*—Matthew Luu
*Assistant Examiner*—Joshua M Dubnow
(74) *Attorney, Agent, or Firm*—Oliff & Berridge, PLC

(57) ABSTRACT

An ink jet head includes a channel unit including a manifold plate and a nozzle plate. The manifold plate has annular grooves. The nozzle plate has annular grooves and nozzles. Each manifold plate annular groove and each nozzle plate annular groove form an annular cavity around one of the nozzles in the channel unit, so that a less rigid region is formed near the nozzle. In a detecting step, the directional deviation of the ink discharged from a nozzle is detected. The detecting step is followed by a deforming step for deforming the nozzle plate by radiating a laser beam to a radiation region in the less rigid region near a defective nozzle. The radiation region varies with the direction and amount in which the ink discharged from the defective nozzle deviates. A nozzle is regarded as defective if the ink discharged from it deviates directionally beyond a specified amount.

7 Claims, 12 Drawing Sheets

INK JET HEAD, METHOD FOR PRODUCING INK JET HEAD, AND DISCHARGE DIRECTION CORRECTING METHOD FOR INK JET HEAD

FIELD OF THE INVENTION

The present invention relates to an ink jet head having a plurality of nozzles which discharge an ink, a method for producing the ink jet head, and a method for correcting the directions in which the ink jet head discharges ink droplets from the nozzles of the head.

BACKGROUND OF THE INVENTION

For example, U.S. Patent Application Publication No. 2003-3202051 corresponding to Japanese Patent Application Laid-open No. 2003-326712 discloses an ink jet head that discharges ink to form an image on recording paper. This ink jet head has a laminated structure formed by laminating thin metal plates. The bottom layer of the ink jet head is a nozzle plate having a large number of nozzles for discharging ink, which are formed through the nozzle plate by press working or laser processing. The ink jet head also has ink channels formed therein, each of which communicates with one of the nozzles.

However, the ink discharged from a nozzle of such an ink jet head may deviate directionally from the prescribed direction. This may be caused by positional shifting between plates that occurs when bonding and securing the plates, displacement of the nozzle axis during nozzle formation, and adhesion of foreign matter to the inner wall of the nozzle. The directional deviation leads to a significant reduction in quality of the image to be formed. Accordingly, if the directional deviation is greater than a predetermined or specified amount, the ink jet head is regarded as defective. There may be a case where the recording paper is positioned at a distance of 1 millimeter below the nozzle plate. In this case, the directional deviation is regarded as greater than the predetermined amount if ink droplets discharged from the nozzle land outside a circular region on the paper that has a radius of several tens of micrometers and a center aligned with the nozzle.

Several hundred to several thousand nozzles are formed in such an ink jet head. The head is rejected if the directional deviation at just a single nozzle is greater than the specified amount. Accordingly, as the number of nozzles increases, the head production yield falls.

SUMMARY OF THE INVENTION

One object of the present invention is to provide an ink jet head high in production yield.

Another object of the invention is to provide a method for producing an ink jet head with high production yield. Still another object of the invention is to provide a method for correcting the directions in which an ink jet head discharges ink droplets, the method being capable of increasing the head production yield.

According to a first aspect of the present invention, there is provided an ink jet head comprising: a plurality of nozzles which discharge an ink; and a plurality of less rigid regions each of which is formed in the vicinity of one of the nozzles and has a rigidity lower than a periphery of each region. The construction of the ink jet head makes it possible to correct the direction in which ink is discharged from a nozzle of the ink jet head. This increases the head production yield.

The ink jet head may have a structure formed by laminating a plurality of plates including a first plate through which the nozzles are formed; and a second plate which adjoins the first plate and has recesses formed therein as the less rigid regions. This makes it possible to effectively correct the direction in which ink is discharged from a nozzle of the ink jet head.

The ink jet head may have a structure formed by laminating a plurality of plates including a nozzle plate through which the nozzles are formed, wherein at least the nozzle plate has recesses formed therein as the less rigid regions. This makes the nozzle plate easy to deform.

In the ink jet head of the present invention, the less rigid regions may be annular and each formed around one of the nozzles. This makes it possible to correct whichever direction the ink discharged from a nozzle of the ink jet head deviates in.

In the ink jet head of the present invention, the less rigid regions may include cavities or portions filled with material having a lower coefficient of elasticity. This makes it easiest to correct the direction in which ink is discharged from a nozzle of the ink jet head.

The ink jet head of the present invention may have a structure formed by laminating a plurality of plates including a nozzle plate through which the nozzles are formed, wherein at least the nozzle plate is formed of material through which a laser beam is transmitted. This makes it possible to effectively correct the direction in which ink is discharged from a nozzle of the ink jet head.

According to a second aspect of the present invention, there is provided an ink jet head comprising a plurality of ink channels formed therein; a plurality of nozzles which jet an ink, each of the nozzles communicating with one of the ink channels; and cavities each of which is formed around one of the nozzles in the ink jet head. The cavity formation around each of the nozzles enables deformation of the periphery of the nozzles so as to correct the direction in which ink is discharged therefrom.

According to a third aspect of the present invention, there is provided a method for producing an ink jet head including a head main body having a plurality of nozzles which discharge an ink, a manifold channel through which the ink is supplied to the nozzles, a plurality of less rigid regions each of which is formed in the vicinity of one of the nozzles and has a rigidity lower than a periphery of each region, the method comprising: a main body forming step for forming the head main body by bonding a plurality of metallic plates together;

a detecting step for detecting directional deviation of the ink discharged from any of the nozzles; and a deforming step for correcting the deviation detected in the detecting step by deforming the less rigid regions in the vicinity of any of the nozzles for which the deviation has been detected.

According to the producing method, the deformation of the less rigid region makes it possible to correct the direction in which ink is discharged from the nozzle. This improves the head production yield.

According to a fourth aspect of the present invention, there is provided a discharge direction correcting method for an ink jet head having a plurality of nozzles which discharge an ink, and a plurality of less rigid regions each of which is formed in the vicinity of one of the nozzles and has a rigidity lower than a periphery of each region, the method comprising: a detecting step for detecting directional deviation of the ink discharged from any of the nozzles; and a deforming step for correcting the deviation detected in the detecting step by deforming the less rigid region in the vicinity of any of the nozzles for which the directional deviation has been detected.

According to the method, the deformation of the less rigid region makes it possible to correct the direction in which ink is discharged from the nozzle. This improves the head production yield.

In the discharge direction correcting method of the present invention, the detecting step may include a step of extracting out of the nozzles a nozzle which discharges an ink in a direction deviating beyond a tolerance, and wherein a less rigid region in the vicinity of the extracted nozzle may be deformed in the deforming step. This makes it possible to correct, among the plurality of the nozzles, only the nozzle for which the discharge direction needs correcting. This in turn shortens the processing time required for the discharge direction correction.

In the discharge direction correcting method of the present invention, the deforming step may involve radiating a laser beam to a portion of the less rigid region in the vicinity of the nozzle for which the deviation has been detected, the portion being determined depending on the direction in which the ink discharged from the nozzle deviates. According to the method, the laser radiation shortens the processing time required for the discharge direction correction.

In the discharge direction correcting method of the present invention, intensity of the laser beam may be varied in accordance with an amount in which the direction deviates. This makes it possible to accurately equalize the directions in which ink is discharged from the nozzles for which the discharge directions have been corrected.

In the discharge direction correcting method of the present invention, an area of the portion to which the laser beam is radiated may be varied in accordance with an amount in which the direction deviates. In the discharge direction correcting method of the present invention, a time for which the laser beam is radiated may be varied in accordance with an amount in which the direction deviates. This stabilizes the processing accuracy because the laser beam output is constant.

In the discharge direction correcting method of the present invention, the deforming step may involve pressing an indenting tool against a portion of the less rigid region in the vicinity of the nozzle for which the deviation has been detected, the portion being determined depending on the direction in which the ink discharged from the nozzle deviates. According to the method, the pressing of the indenting tool enables low-cost processing for the direction correction.

In the discharge direction correcting method of the present invention, a load with which the indenting tool is pressed may be varied in accordance with the amount in which the direction deviates. According to the method, this enables accurate correction of the directional deviation.

In the discharge direction correcting method of the present invention, a number of points of the portion against which the indenting tool is pressed may be varied in accordance with the amount in which the direction deviates. According to the method, the indenting tool can be pressed with a constant load, so that the processing accuracy is stable.

DETAILED DESCRIPTION OF PREFERRED EMBODIMENTS

Preferred embodiments of the present invention will be described below with reference to the drawings.

Figure 1:
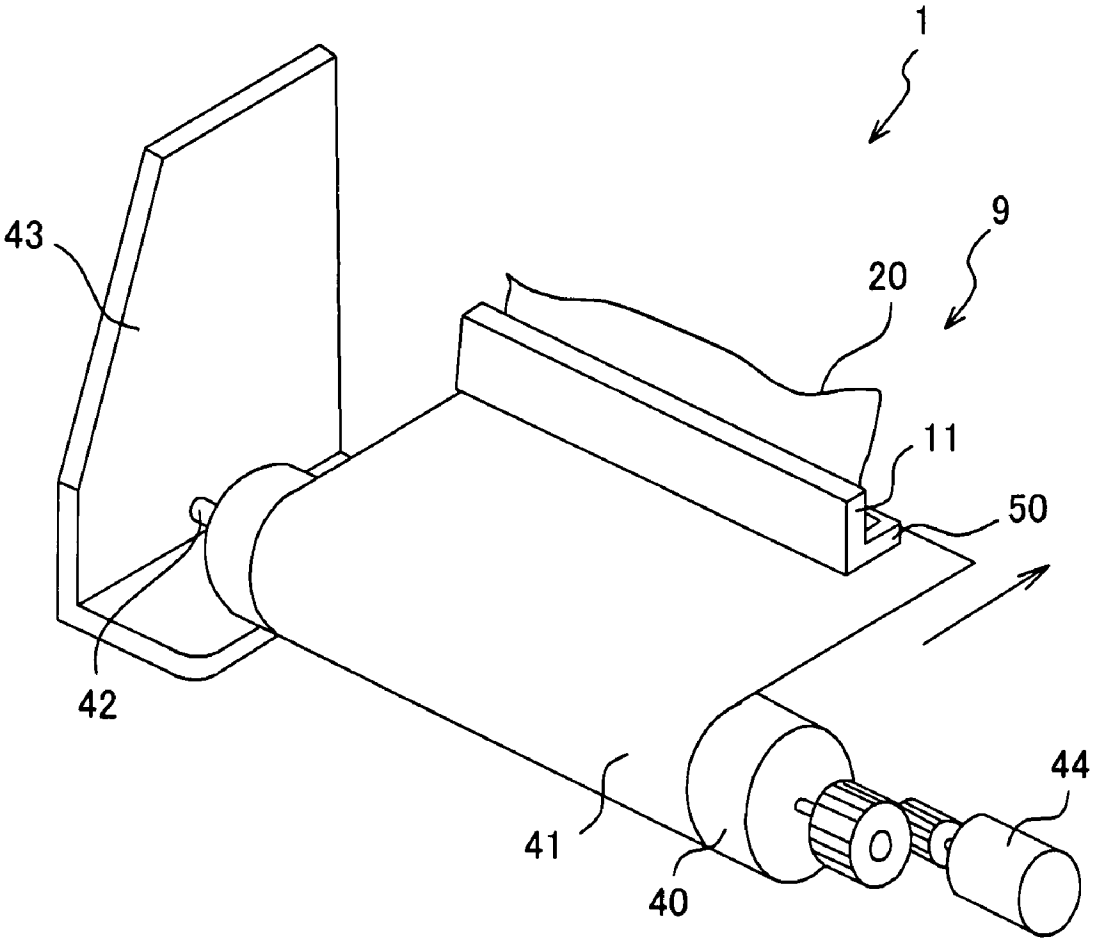
FIG. 1 is a schematic perspective view of an ink jet printer having an ink jet head according to a first embodiment of the present invention.

As shown in FIG. 1, an ink jet printer 1 includes a platen roller 40, an ink jet head 9 and a flexible printed circuit (FPC) 20. The platen roller 40 conveys paper 41 as a recording medium. The ink jet head 9 discharges ink onto paper 41 set on the platen roller 40. A control unit (not shown) applies a driving voltage via the FPC 20 to the ink jet head 9.

The platen roller 40 is fixed to a shaft 42, which is supported rotatably by a frame 43 and is rotated by a motor 44. Paper 41 is fed from a paper cassette (not shown), which is provided near the ink jet printer 1. The platen roller 40 conveys the fed paper 41 at a constant speed in the direction indicated by the straight arrow in FIG. 1. While paper 41 is conveyed, the ink jet head 9 discharges ink so that a predetermined printing is performed on the paper. Then, the printed paper 41 is discharged from the ink jet printer 1. FIG. 1 omits a detailed illustration of the paper feeding and discharging mechanisms. The ink jet printer 1 as shown in FIG. 1 is a monochromatic printer, which includes only one ink jet head 9. For color printing, at least four ink jet heads 9 for yellow, magenta, cyan and black are positioned in parallel.

As shown in FIG. 1, the ink jet head 9 is a line head extending perpendicular to the conveying direction in which paper 41 is conveyed. The ink jet head 9 is fixed with respect to the frame 43. The ink jet head 9, which discharges ink onto paper 41, includes a head main body 50 and a base part 11. The head main body 50 extends in a direction (direction orthogonal to the conveying direction). The base part 11 extends in a direction perpendicular to the head main body 50 and supports the head main body 50.

Figure 3:
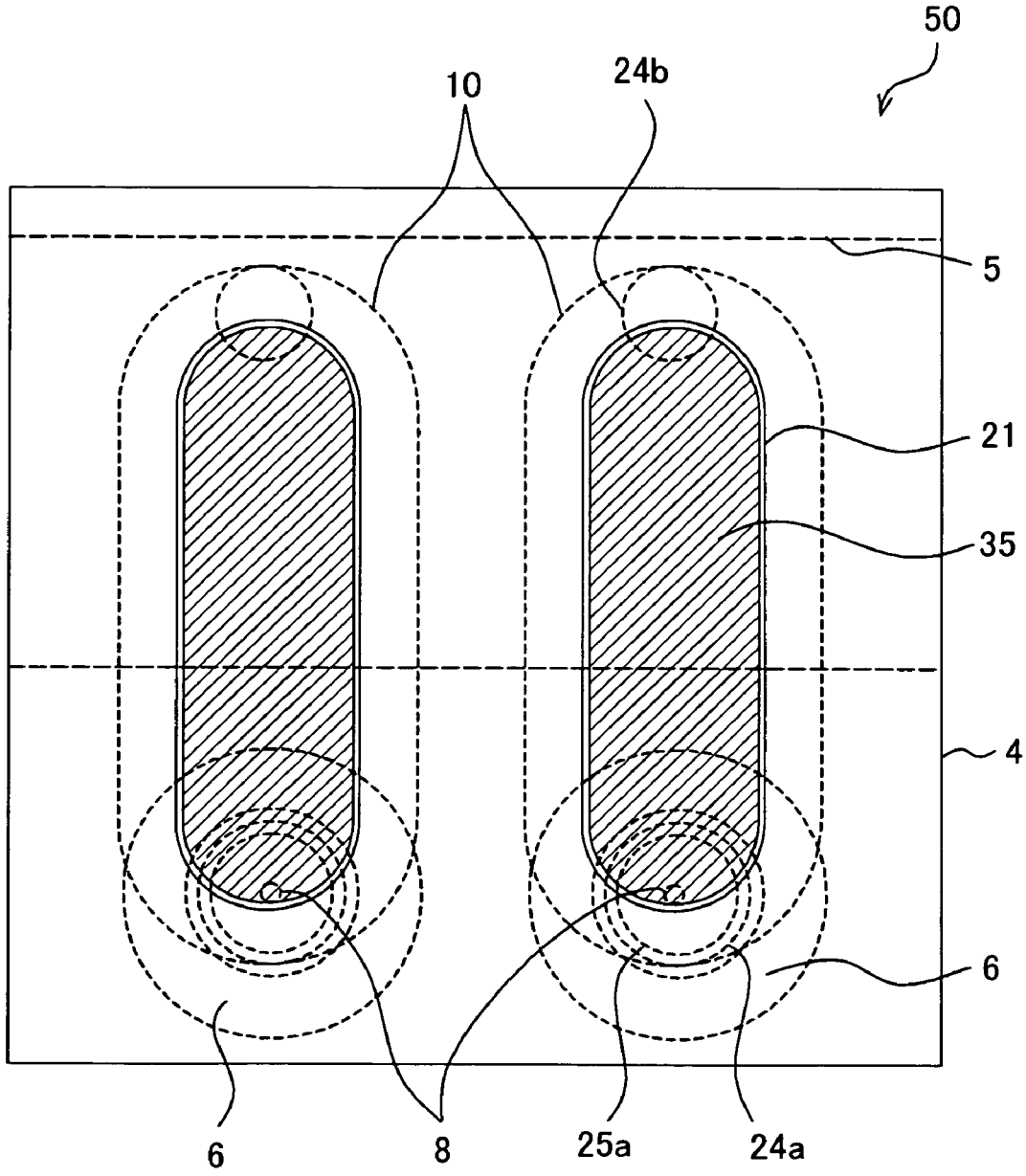
FIG. 3 is an enlarged view of the portion of the head main body that is surrounded by the chain lines in FIG. 2.
Figure 4:
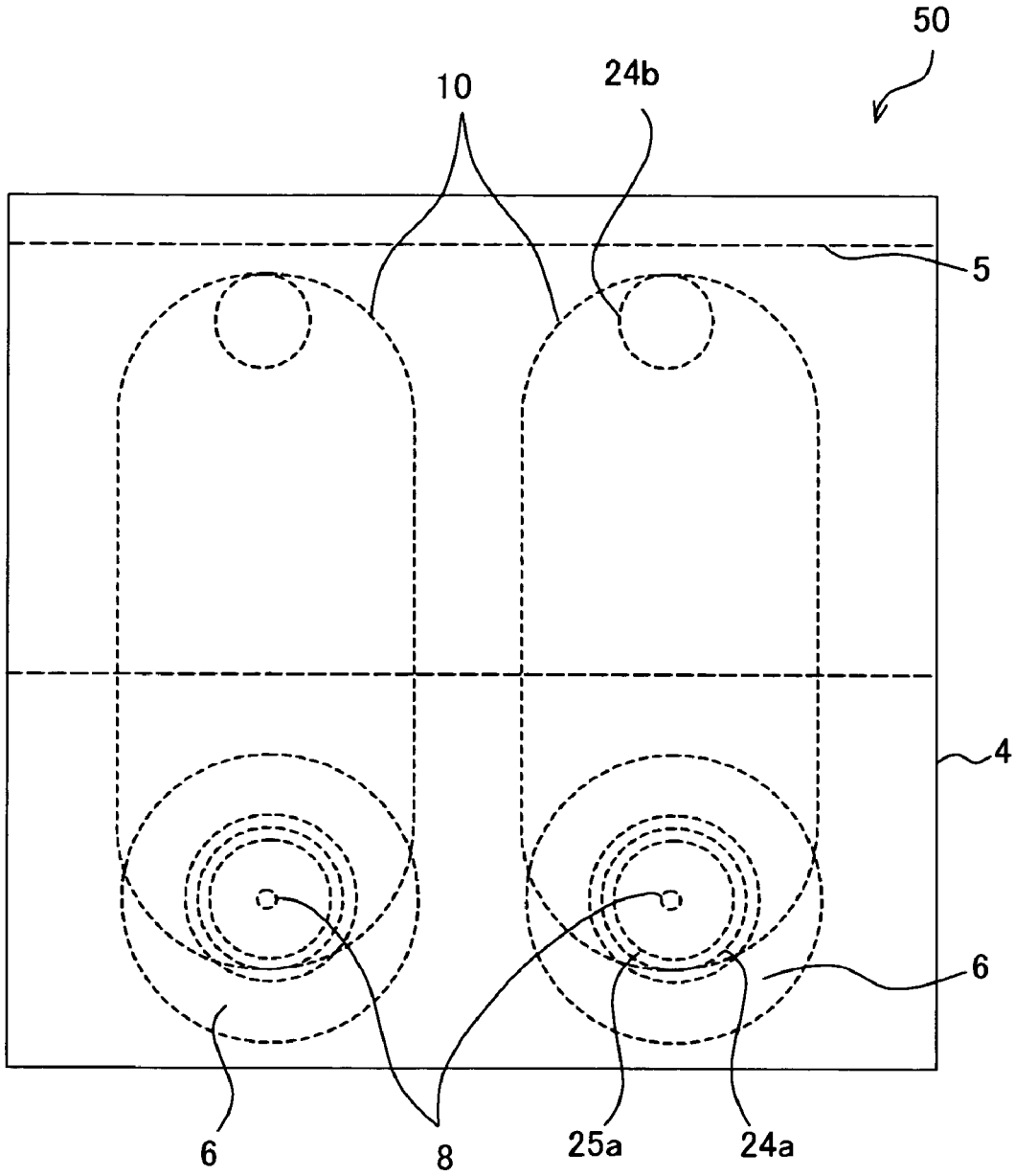
FIG. 4 is a bottom view of the portion of the head main body as shown in FIG. 3.

The head main body 50 has a large number of nozzles 8 (see FIG. 3) formed through the bottom surface of the ink jet head 9 (ink discharge surface of the head main body 50). The bottom surface is parallel with the portion of paper 41 that has left the platen roller 40. The nozzles 8 are arrayed in a line along a longitudinal direction of the head main body 50. The driving voltage from the control unit is transmitted through the FPC 20 to the head main body 50, so that ink which is discharged through the nozzles 8 flies toward the paper 41. The FPC 20 is connected electrically to piezoelectric sheets 21, which are formed at the top surface of the head main body 50. The piezoelectric sheets 21 will be described later on.

With reference to FIGS. 2 to 6, the head-main body 50 will be described in more detail below.

Figure 2:
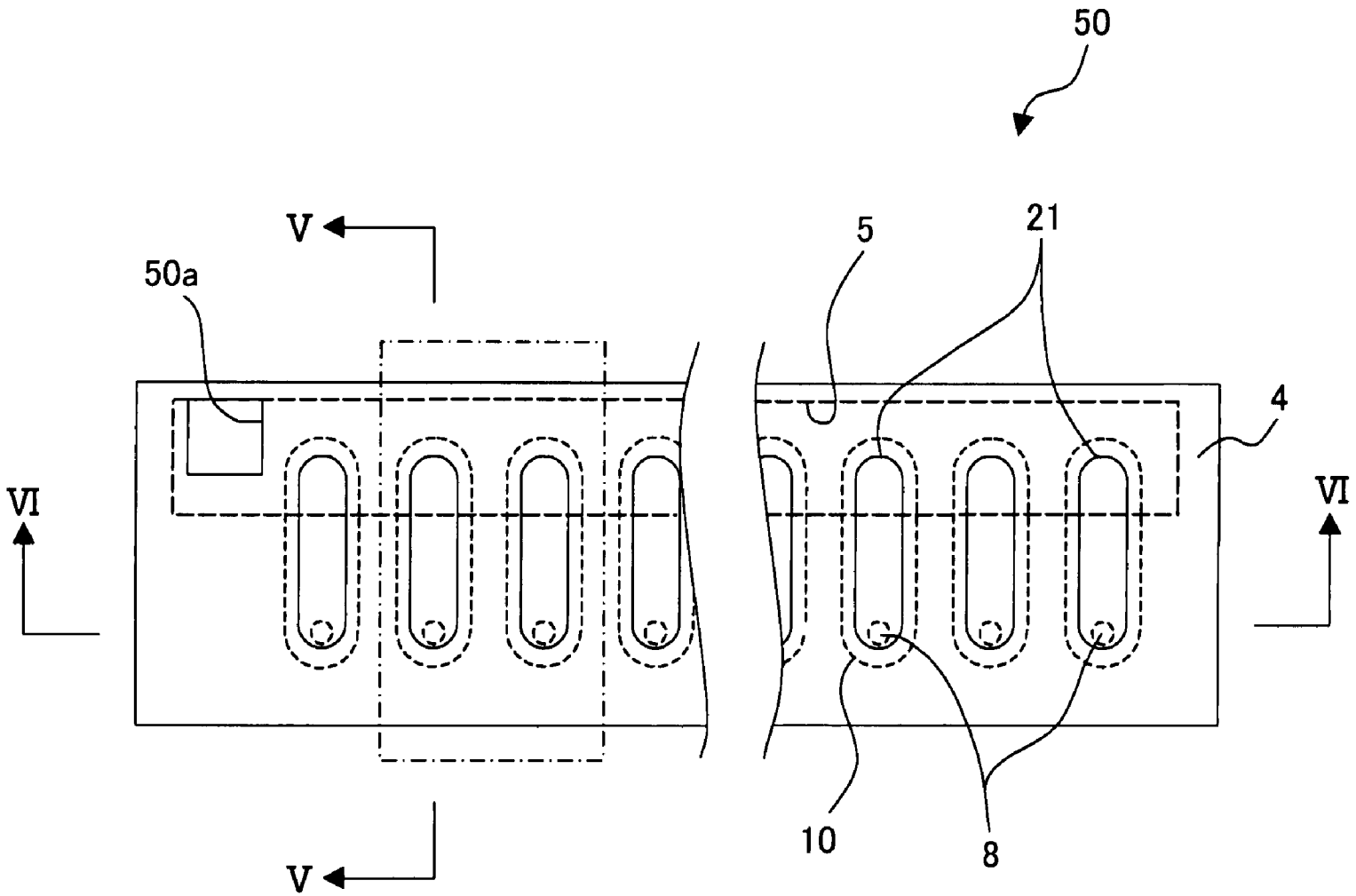
FIG. 2 is a plan view of the head main body of the ink jet head shown in FIG. 1.

As shown in FIG. 2, the head main body 50 includes a channel unit 4 and piezoelectric sheets 21 which are formed on the top surface of the channel unit 4. The channel unit 4 is rectangular in plan view. The channel unit 4 has a manifold channel 5 formed therein and extending in a longitudinal direction of the channel unit 4. The head main body 50 has an ink supply port 50*a* formed at one end thereof (the left end of the channel unit 4 in FIG. 2). The ink supply port 50*a* communicates with the manifold channel 5 and is connected to an ink tank (not shown) via a tube or the like so that ink is supplied from the tank to the channel 5.

Figure 5:
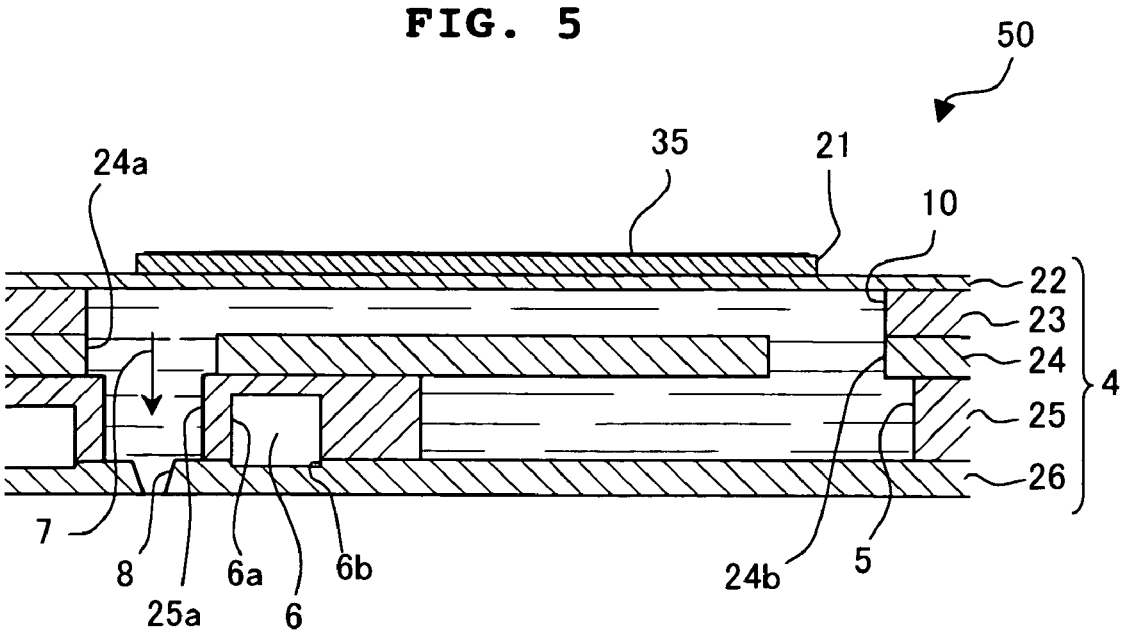
FIG. 5 is a cross section of the head main body that is taken along line V-V in FIG. 2.

As shown in FIG. 2, the channel unit 4 has a large number of pressure chambers 10 formed therein and arrayed along a longitudinal direction of the channel unit 4. The pressure chambers 10 are elliptic in plan view and extend parallel to a transverse direction of the channel unit 4. As shown in FIG. 5, one end of each pressure chamber 10 communicates with one of the nozzles 8, and the other end communicates with the manifold channel 5. This results in the manifold channel 5 communicating with a large number of separate ink channels 7 each of which leads through one of the pressure chambers 10 to the associated nozzle 8.

As shown in FIGS. 3 to 6, the channel unit 4 has annular cavities 6 each formed in an area corresponding to a periphery of nozzle 8 in the vicinity of the ink discharge surface, namely around the portion of one of the separate ink channels 7 that extends between the associated pressure chamber 10 and nozzle 8. The formation of annular cavities 6 results in less rigid and more deformable regions being formed near the nozzles 8 in the channel unit 4.

A large number of piezoelectric sheets 21 are formed on the top surface of the channel unit 4 and arrayed along the longitudinal direction of the channel unit 4. The piezoelectric sheets 21 are elliptic in plan view and extend parallel to the transverse direction of the channel unit 4. Each piezoelectric sheet 21 is arranged in a position corresponding to one of the pressure chambers 10 formed in the channel unit 4.

Figure 6:
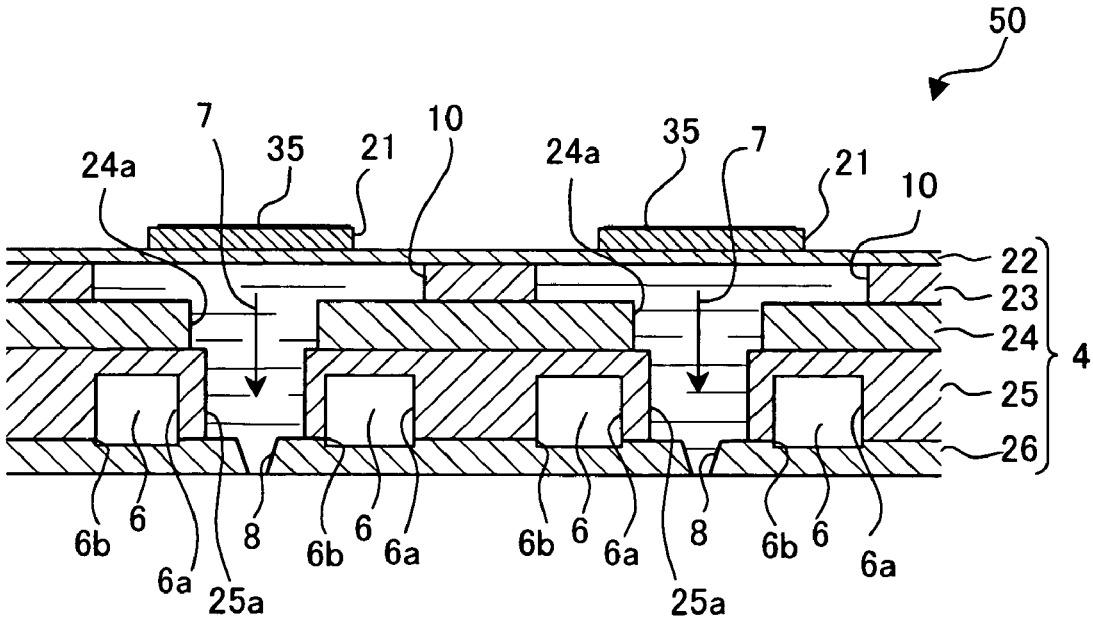
FIG. 6 is a partial cross section of the head main body that is taken along line VI-VI in FIG. 2.

As shown in FIGS. 5 and 6, the head main body 50 has a laminated structure formed by laminating six sheet layers which are piezoelectric sheets 21, an actuator plate 22, a cavity plate 23, a supply plate 24, a manifold plate 25 and a nozzle plate 26 laminated in this order from the uppermost layer. The piezoelectric sheets 21 are formed of a ceramic material such as lead zirconate titanate (PZT). The other five plates 22 to 26 are formed of metallic material and form the channel unit 4.

As described later on in detail, a separate electrode 35 is formed on the top surface of each piezoelectric sheet 21. Application of driving voltage to the separate electrode 35 causes the piezoelectric sheet 21 to function as an active part.

The ink supply port 50*a* (FIG. 2) is formed through the metallic actuator plate 22 and communicates with the manifold channel 5 via holes (not shown) cut through the metallic cavity plate 23 and metallic supply plate 24. The pressure chambers 10 are cavities formed through the cavity plate 23, each under the associated piezoelectric sheet 21. The supply plate 24 has communication holes 24*a* and 24*b* cut therethrough. The manifold channel 5 is formed through the metallic manifold plate 25, which has communication holes 25*a* cut therethrough. Each pressure chamber 10 communicates with the manifold channel 5 via one of the communication holes 24*b*. Each pressure chamber 10 also communicates with the associated nozzle 8 via one of the communication holes 24*a* and one of the communication holes 25*a*. The nozzles 8 are formed through the metallic nozzle plate 26 under the respective chambers 10.

As shown in FIGS. 5 and 6, the manifold plate 25 has annular grooves 6*a* open downwardly and formed on the lower side thereof (on the bonding side with the nozzle plate 26), each around one of the communication holes 25*a*. Likewise, the nozzle plate 26 has annular grooves 6*b* open upwardly and formed on the upper side thereof (on the bonding side with the manifold plate 25), each around one of the nozzles 8. With these plates 25 and 26 bonded together, the annular grooves 6*a* and 6*b* form annular cavities 6. The annular grooves 6*b* of the nozzle plate 26 are shallower than the annular grooves 6*a* of the manifold plate 25.

The cavities, holes and grooves of the five plates 22 to 26 are formed by pressing and etching. The five plates 22 to 26 are aligned and laminated with one another so that separate ink channels 7 as shown in FIGS. 5 and 6 are formed. The separate ink channels 7 extend upwardly from the manifold channel 5, horizontally through the respective pressure chambers 10 and downwardly to the respective nozzles 8.

The separate electrodes 35, which is formed on the top surface of the respective piezoelectric sheets 21, are formed of metallic material. Each separate electrode 35 is connected electrically to independent wiring formed on or through the FPC 20. This enables the control unit to control the potential for each pressure chamber 10 through the wiring of the FPC 20. The actuator plate 22 functions as a common electrode, the potential of which is maintained at the ground potential.

A method for driving the piezoelectric sheets 21 will be described below. The piezoelectric sheets 21 are polarized across their thickness. Application of potential higher than the ground potential to each separate electrode 35 results in an electric field being applied to a portion of the associated piezoelectric sheet 21 in the direction of polarization. The application of the electric field causes this sheet portion to act as an active layer, which tends to expand up and down and contract transversely due to a piezoelectric transverse effect. This results in the piezoelectric sheet 21 and actuator plate 22 deform so as to project toward the pressure chamber 10 (unimorph deformation). At this time, as shown in FIGS. 5 and 6, the lower surface of the actuator plate 22 is fixed on the upper surface of the partitioning wall (cavity plate) 23 which partitions the pressure chambers 10. Consequently, the volume of the associated pressure chamber 10 decreases, so that the pressure of the ink therein increases. As a result, ink is discharged from the associated nozzle 8. Subsequently, when the potential of the separate electrode 35 is switched back to that of the actuator plate 22, which acts as the common electrode, the piezoelectric sheet 21 and actuator plate 22 return to their original shapes. This restores the pressure chamber 10 to its original volume, thereby sucking ink into the pressure chamber 10 from the manifold channel 5.

Another method for driving the piezoelectric sheets 21 will be described below. In advance, the potential of the separate electrodes 35 is maintained at a value different from the potential of the actuator plate 22 which acts as the common electrode. In accordance with each discharge request, the potential of the appropriate electrode 35 is equalized once to that of the actuator plate 22. At a predetermined timing thereafter, the potential of the separate electrode 35 is switched back to the different potential from that of the actuator plate 22. In this case, when the potentials of the separate electrode 35 and actuator plate 22 are equal, the piezoelectric sheet 21 and actuator plate 22 return to their original shapes. This increases the volume of the associated pressure chamber 10 in comparison with its initial volume, thereby sucking ink into the pressure chamber 10 from the manifold channel 5. Subsequently, the separate electrode 35 is applied with a potential again at a timing different from the timing when the actuator plate 22 is applied with the potential. As a result, the piezoelectric sheet 21 and actuator plate 22 deform to project toward the pressure chamber 10, thereby reducing the volume of the pressure chamber 10. This raises the ink pressure in the pressure chamber 10, thereby discharging ink through the associated nozzle 8. In this way, a desired image is printed on the paper 41 being conveyed.

Figure 7:
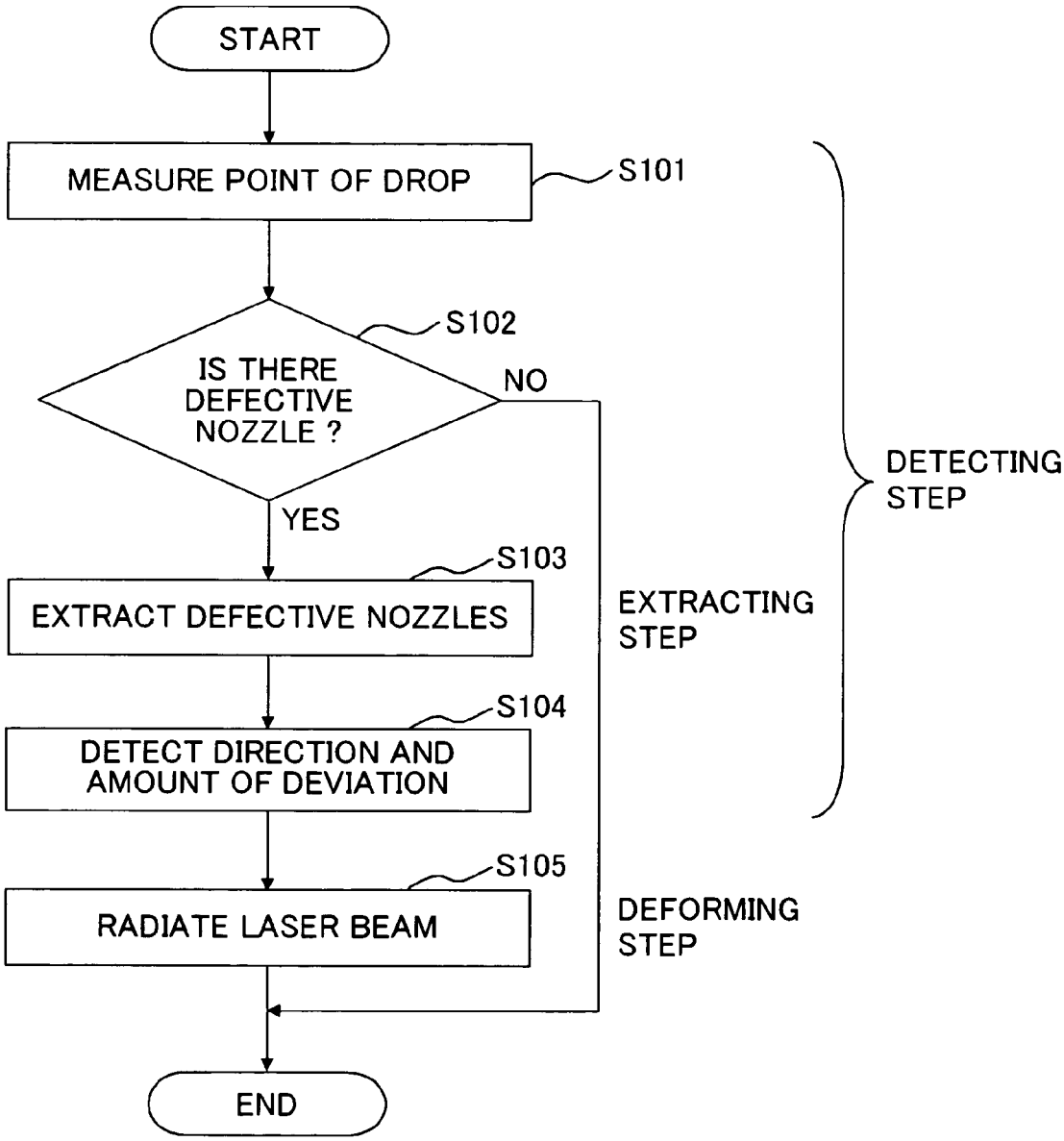
FIG. 7 is a flowchart of a procedure for correcting the directions in which ink droplets are discharged from the ink jet head shown in FIG. 1.

With reference to FIG. 7, a description will be provided below of a method for correcting the direction in which ink is discharged from a nozzle 8.

The correcting method is executed following a step for forming the head main body 50 by laminating the piezoelectric sheets 21, actuator plate 22, cavity plate 23, supply plate 24, manifold plate 25 and nozzle plate 26 (main body forming step).

Figure 8A:
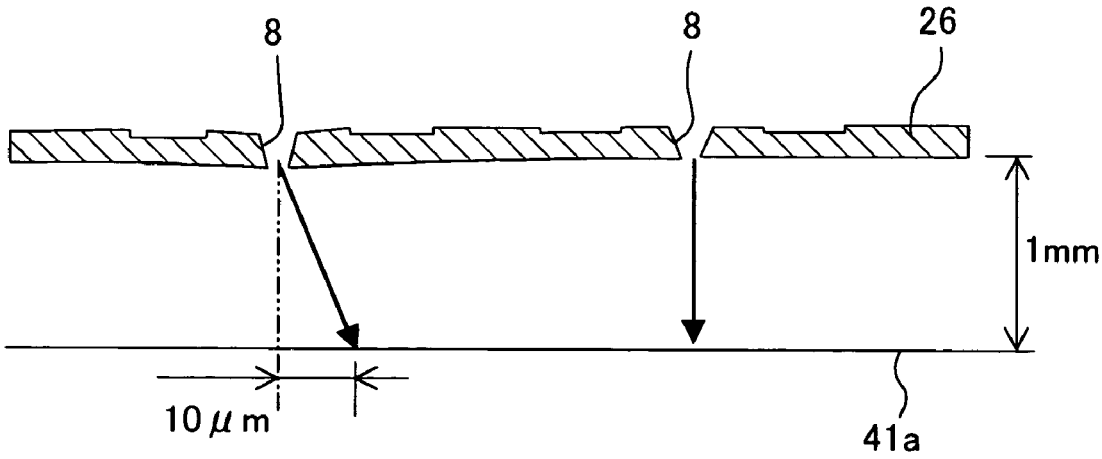
FIGS. 8A and 8B show test printing for measuring the points on which ink droplets land from the ink jet head shown in FIG. 1, and the results of the test printing.
Figure 8B:
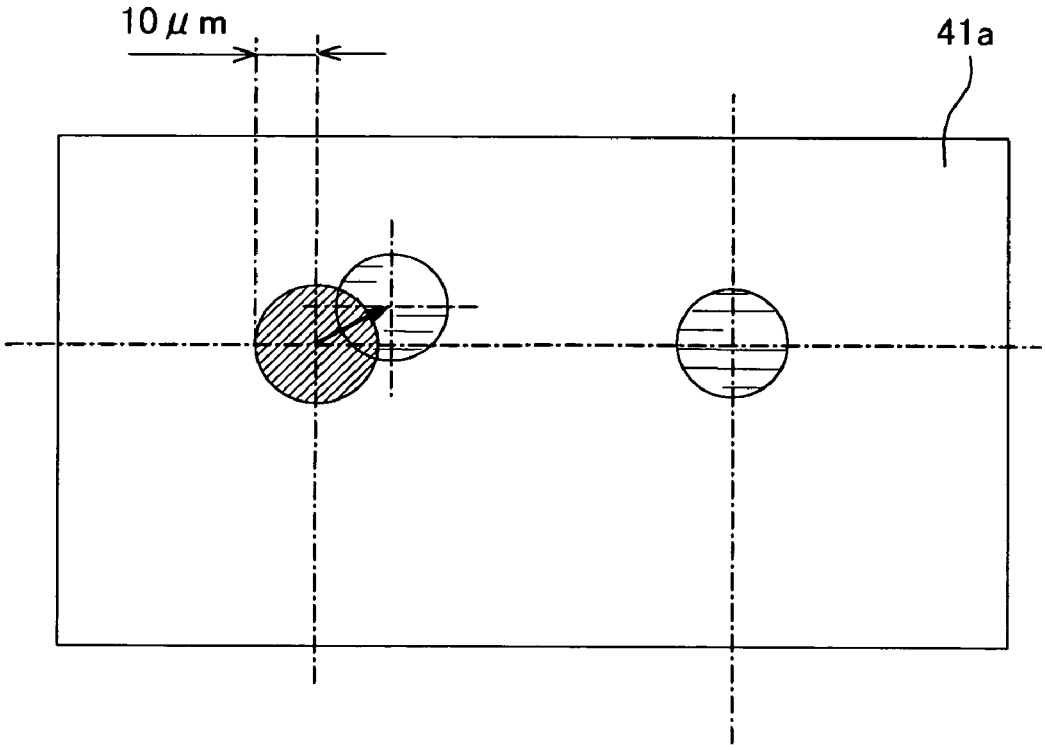

As step S101, as shown in FIG. 8A, paper 41*a* for test printing is positioned at a distance of 1 millimeter below the bottom surface of the nozzle plate 26. In step S101, ink droplets are discharged from nozzles 8 to measure the position where the discharged droplets have landed on the paper 41*a*. FIG. 8B shows the results of the test printing in step S101. With reference to FIG. 8B, each of the points of intersection where mutually perpendicular chain lines intersect with each other is aligned with one of the nozzles 8 on the paper 41. In FIG. 8B, the circular regions hatched with wide spaced lines indicate where the ink droplets have landed. The right and left circular regions hatched with wide spaced lines in FIG. 8B represent the ink droplets discharged from the right and left nozzles 8 respectively in FIG. 8A.

Because steps S102 to S104, which will be described later on, involve image processing using a computer, the results of the test printing in step S101 are entered into the computer. As stated already, the nozzles 8 are formed through the nozzle plate 26 and arrayed in line. The ink droplets on the paper 41*a*, each of which has been discharged from one of the nozzles 8, is designated with numbers 1, 2, 3 . . . and so on from the left end of the nozzle plate 26. The droplet numbers are then stored in the computer.

Next, as step S102, it is determined whether there are defective nozzles 8 or not. The determination involves image processing based on the measurement results in step S101. If the ink discharged from a nozzle 8 deviates directionally beyond a specified amount, and if the directional deviation needs correcting, the nozzle 8 is regarded as defective. In this embodiment, the directional deviation is defined as greater than the specified amount if an ink droplet from the nozzle 8 lands with its center outside a proper region on paper 41*a*. In FIG. 8B, the proper region is shown as a circular region hatched with oblique lines, which has a radius of 10 micrometers and a center aligned with the nozzle 8. In FIG. 8B, the right droplet has landed within the associated proper region, and the left droplet has landed with its center outside the associated proper region. Accordingly, the left nozzle 8 in FIG. 8A, from which the left droplet has been discharged, is regarded as defective.

If it is determined in step S102 that there is no defective nozzle 8 (NO in step S102), the ink jet head 9 is completed as non-defective. If it is determined in step S102 that there is at least one defective nozzle 8 (YES in Step S102), the procedure moves to step S103. Step S103 includes extracting, based on the measurement results in step S101, the ink droplets landed protruding from the respective proper regions. Step S103 also includes storing the corresponding droplet numbers as the nozzle numbers of defective nozzles 8. In other words, step S103 is to extract the defective nozzles 8 from all nozzles 8 (extracting step).

Next, as step S104, it is detected, by image processing, the directions and amounts in which the protruding droplets extracted in step S103 deviate from the respective proper regions. Step S104 also includes storing the detected directions and amounts of deviation as associated with the nozzle numbers of the respective defective nozzles 8. Steps S101 to S104 constitutes a detecting step.

Figure 9:
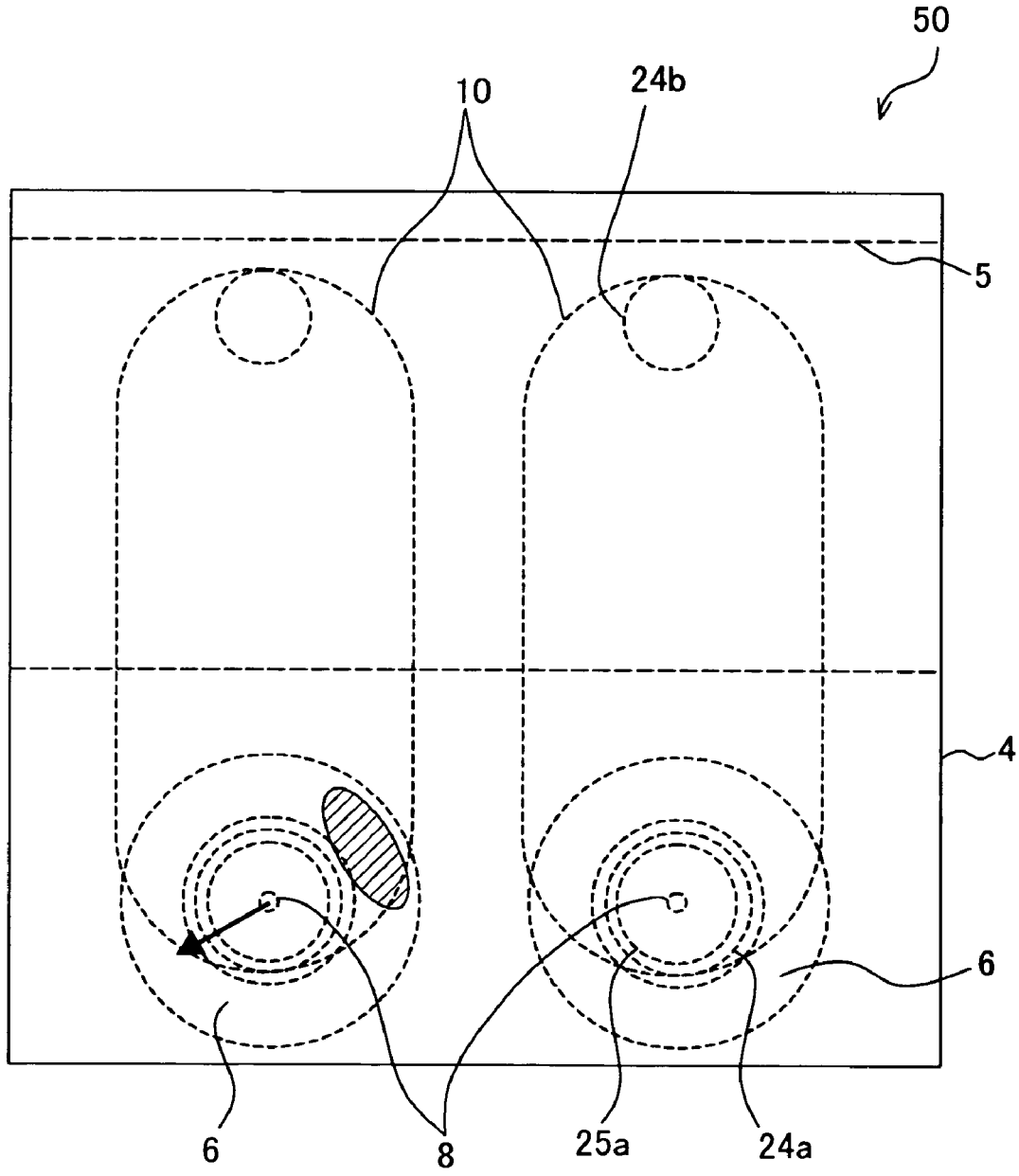
FIG. 9 shows a radiation region as viewed from the bottom side of the ink jet head shown in FIG. 1.

The direction and amount of deviation detected for each defective nozzle 8 in step S104 are the bases for determining a region (hereinafter referred to simply as radiation region) as part of the less rigid region near the nozzle 8 in the head main body 50. The last step S105 is a deforming step for radiating a laser beam to the radiation regions for the defective nozzles 8 to deform the nozzle plate 26 by the laser forming method so as to correct the directions in which ink is discharged from these nozzles (deforming step). The laser forming method will be described later on. One of the radiation regions is shown as a hatched region in FIG. 9 showing a bottom view of the head main body 50 viewed from the ink discharge surface. In FIG. 9, the thick arrow indicates the direction and amount in which the ink discharged from a defective nozzle 8 deviates. With respect to each defective nozzle 8, the associated radiation region is positioned opposite the direction in which the ink discharged from the nozzle 8 deviates. The laser beam is constant in intensity. The radiation regions are varied in area according to the respective amounts of deviation.

The laser forming method will be described below. If a metallic material is irradiated with and absorbs a laser beam having a high energy density, the temperature of the material rises sharply. This causes a great thermal stress in the metallic material due to partial thermal expansion of the material. If one side of a metallic material is irradiated with a laser beam, the temperature of this side rises more greatly than that of the other side. When the heated material cools down, its irradiated side contracts more greatly than the other side. For this reason, while the metallic material is heated and/or cooled, plastic flow occurs therein, which causes bending deformation therein. The laser forming method is a method for deforming a metallic material by such bending deformation.

The deformation of the nozzle plate 26 in step S105 corrects the direction in which ink is discharged from each defective nozzle 8. This completes a non-defective ink jet head 9.

Figure 10A:
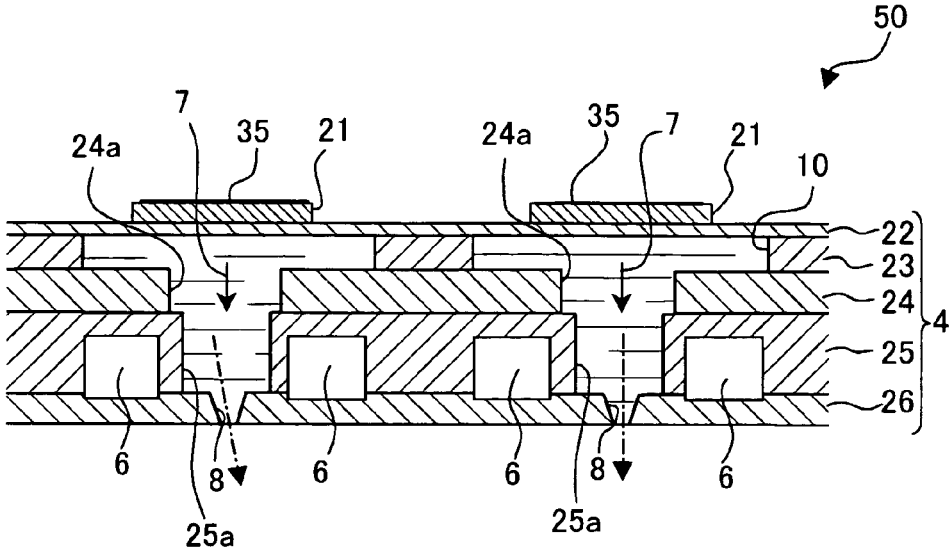
FIGS. 10A to 10C show a deforming process for correcting the direction in which an ink droplet is discharged from the ink jet head shown in FIG. 1.
Figure 10B:
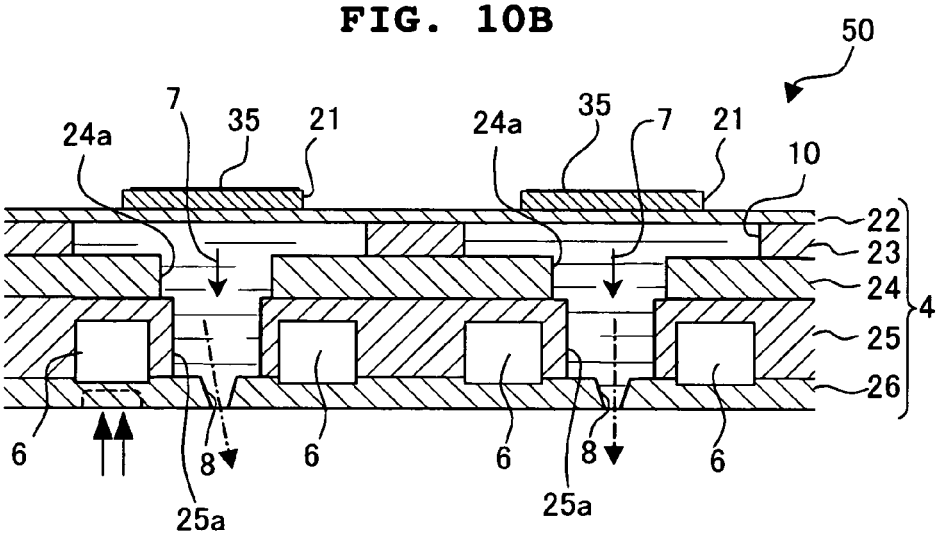
Figure 10C:
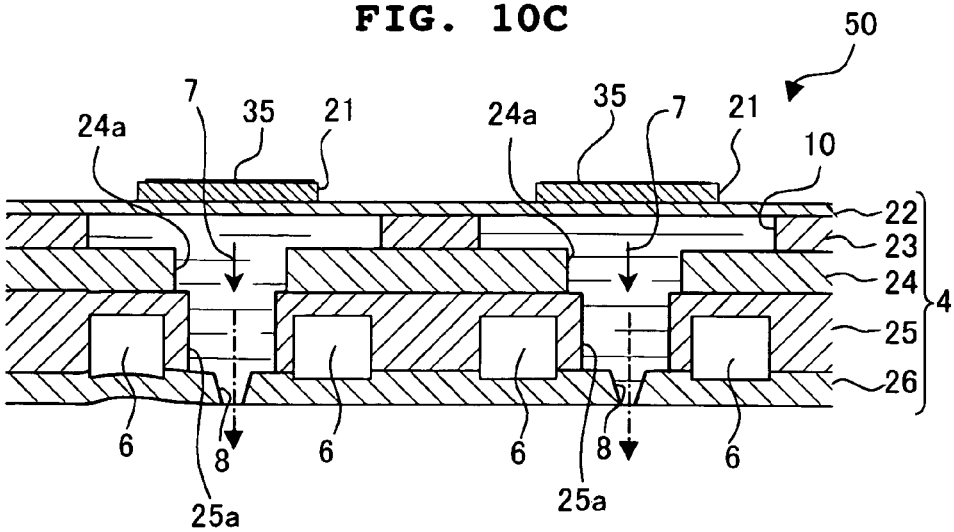

The deforming step will be described below in detail with reference to FIGS. 10A to 10C showing a deforming process. In FIGS. 10A to 10C, the chain arrows indicate the directions in which ink is discharged from nozzles 8.

In FIG. 10A, ink is discharged from the right nozzle 8 in the direction perpendicular to the bottom surface of the nozzle plate 26 (ink discharge surface), and this direction dose not need correction. In FIG. 10A, the ink discharged from the left nozzle 8 deviates directionally beyond the specified amount, and the directional deviation needs correction. The ink discharged from the left nozzle 8 deviates from the perpendicular direction to the right in the sheet surface of FIG. 10A. Therefore, as shown in FIG. 10B, a laser beam is radiated to the radiation region surrounded by the dotted line. The radiation region is located in the nozzle plate 26 and on the left side of the left nozzle 8 in FIG. 10B. The radiation region is part of the less rigid region near the left nozzle 8. As a result, as shown in FIG. 10C, the vicinity of the left nozzle 8 deforms so that the discharge direction is perpendicular to the bottom surface of the nozzle plate 26. It is efficient to determine in advance how much the discharge direction changes with various points of laser radiation, various powers and various lengths of radiation time. The determined results is the basis for selecting a point of laser radiation, a power and a length of radiation time according to the directional deviation.

As described above, the correcting method includes the detecting step for detecting the deviation of the direction in which ink is discharged from a defective nozzle 8 of the ink jet head 9. As described above, the method further includes the deforming step for deforming the less rigid region near the defective nozzle 8 so as to correct the directional deviation detected in the detecting step. This makes it possible to improve the head production yield.

The detecting step includes the extracting step for extracting the defective nozzles from nozzles 8 of the ink jet head 9. The deforming step is to deform the less rigid region near each extracted nozzle 8. Since only the defective nozzles 8 are corrected, it is possible to shorten the processing time for the direction correction.

Since the less rigid region is deformed by irradiating the radiation region therein with a laser beam, it is possible to shorten the processing time for the direction correction. Since the laser beam output is constant, and since the area of the radiation region is determined in accordance with the amount in which the ink discharged from the nozzle 8 deviates directionally, the processing accuracy is stable.

Since the less rigid regions are formed near the respective nozzles 8, it is possible to correct the direction in which ink is discharged from each defective nozzle 8. This results in a high production yield.

As described above, each of the less rigid regions includes an annular cavity 6 consisting of two annular grooves 6*a* and 6*b* which are formed in the manifold plate 25 and nozzle plate 26, respectively. The manifold plate 25 is bonded to the top surface of the nozzle plate 26. This makes it easiest to correct the direction in which ink is discharged from each defective nozzle 8. Since the less rigid regions are formed in the manifold plate 25, the direction can be corrected effectively.

Each annular cavity 6 is formed in a region in the channel unit 4 that is near to the bottom surface of the nozzle plate 26 and that surrounds the associated nozzle 8. This makes it possible to correct whichever direction the ink discharged from the nozzle 8 deviates in.

Figure 11A:
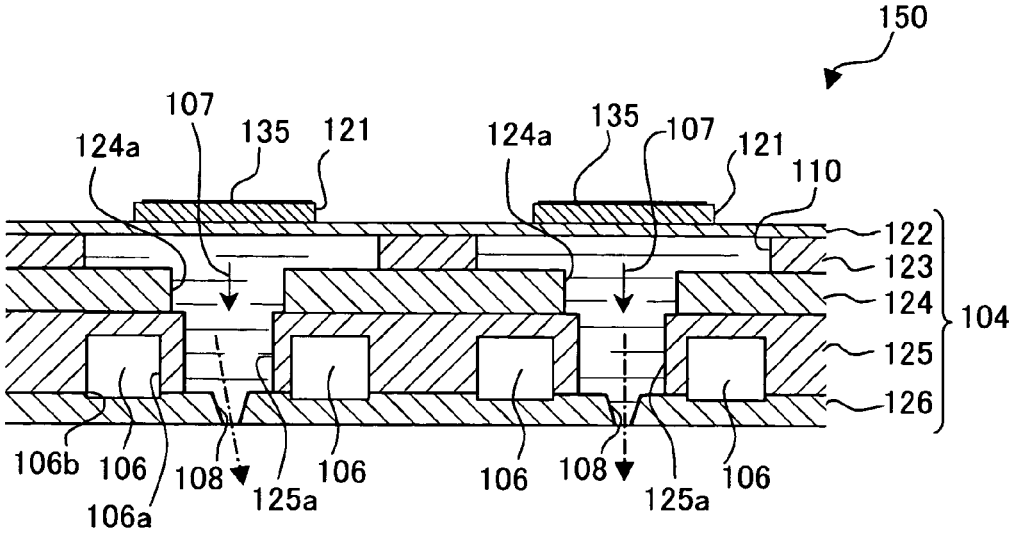
FIGS. 11A to 11C show a deforming process for correcting the direction in which an ink droplet is discharged from an ink jet head according to a second embodiment of the present invention.
Figure 11B:
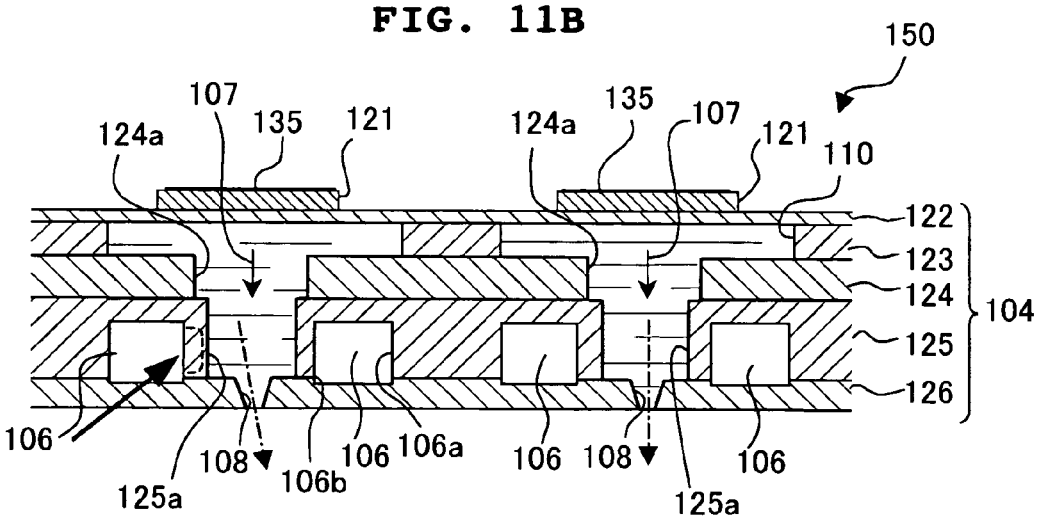
Figure 11C:
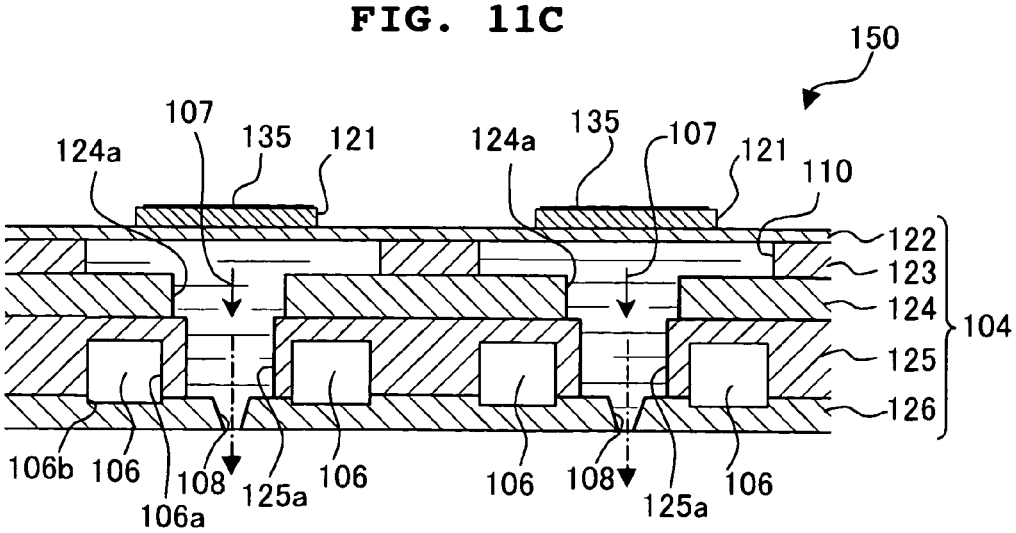

With reference to FIGS. 11A to 11C, a second embodiment of the present invention will be described below.

An ink jet head according to this embodiment differs in structure from the ink jet head 9 according to the first embodiment mainly as follows. The channel unit 4 of the ink jet head 9 is constituted of five plates 22 to 26 formed of metallic material. The channel unit 104 of the ink jet head according to this embodiment is constituted of four plates 122 to 125 formed of metallic material and a plate 126 formed of transparent glass. Otherwise, the ink jet head according to this embodiment is similar in structure to the ink jet head 9 shown in FIGS. 2 to 6. The similar parts will not be described in detail.

The head main body 150 of the ink jet head according to this embodiment has the channel unit 104 and a plurality of piezoelectric sheets 121 arranged on the top surface of the channel unit 104. The channel unit 104 has a laminated structure in which an actuator plate 122, a cavity plate 123, a supply plate 124, a manifold plate 125 and a nozzle plate 126 are laminated. As stated above, the plates 122 to 125 are formed of metallic material. The plate 126 is formed of transparent quartz glass.

The channel unit 104 has a manifold channel (not shown), a plurality of pressure chambers 110, separate ink channels 107 and annular cavities 106 all formed therein. The nozzle plate 126 has nozzles 108 formed therethrough. The manifold channel communicates with the pressure chambers 110. Each separate ink channel 107 connects one of the pressure chambers 110 to one of the nozzles 108. Each annular cavity 106 is formed near the bottom surface of the nozzle plate 126 and around one of the nozzles 108.

A method for correcting the direction in which ink is discharged from a nozzle 108 of this ink jet head differs from the correcting method for the first embodiment mainly as follows. In the deforming step for the first embodiment, the bottom surface of the nozzle plate 26 is irradiated with a laser beam. In the deforming step for the second embodiment, the laser beam emitted onto the bottom surface of the nozzle plate 26 of glass penetrates through this plate and is radiated to the manifold plate 25. The other steps for this embodiment are similar to the counterparts for the first embodiment, which are shown in FIG. 7, and will not be described in detail.

As is the case with the first embodiment, a nozzle 108 is regarded as defective if the ink discharged therefrom deviates directionally beyond a specified amount, and if the directional deviation needs correction. The procedure for correcting the direction in which ink is discharged from a nozzle 108 includes a detecting step for extracting the defective nozzles from nozzles 108 and detecting the direction and amount in which the ink discharged from each extracted nozzle 108 deviates. This correcting procedure further includes a deforming step for deforming the vicinity of each defective nozzle 108 based on the detection results in the detecting step.

With reference to FIGS. 11A to 1C, the deforming step will be described below in detail. In FIG. 11A, the ink discharged from the left nozzle 108 deviates to the right from the direction perpendicular to the bottom surface of the nozzle plate 126 (ink discharge surface). Therefore, as shown in FIG. 11B, a laser beam is radiated to the radiation region 125*a* surrounded by the dotted line (see FIG. 11B). The radiation region for a defective nozzle 108 is formed in the manifold plate 125 and on the opposite side of the nozzle to the direction in which ink is discharged from it. The radiation region is located inside the inner peripheral wall of the annular cavity 106 formed around the nozzle 108. Specifically, this region is located inside the inner peripheral wall of the associated annular groove 106*a* in the manifold plate 125. The area of the radiation region is determined in accordance with the amount in which the ink discharged from the nozzle 108 deviates directionally. As shown in FIG. 1C, the radiation of a laser beam to the radiation region deforms the vicinity of the left nozzle 108. The deformation corrects the left nozzle 108 so that the direction in which ink is discharged therefrom is perpendicular to the bottom surface of the nozzle plate 126.

Thus, as is the case with the correcting method for the first embodiment, the correcting method for the second embodiment makes it possible to improve the head production yield.

Because the nozzle plate 126, through which the nozzles 108 are formed, is formed of transparent glass, the manifold plate 25, which is bonded to the nozzle plate 126, can be irradiated with a laser beam in the deforming step. This enables effective correction of the direction in which ink is discharged from a defective nozzle 108.

The ink jet head according to this embodiment has other advantages as that according to the first embodiment has.

Figure 12A:
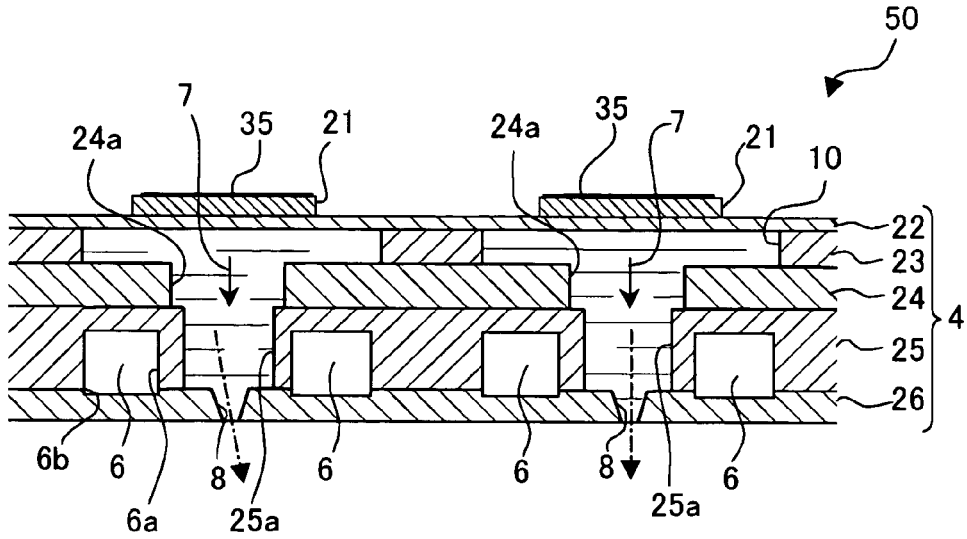
FIGS. 12A to 12C show a deforming process for correcting the direction in which an ink droplet is discharged from an ink jet head according to a third embodiment of the present invention.
Figure 12B:
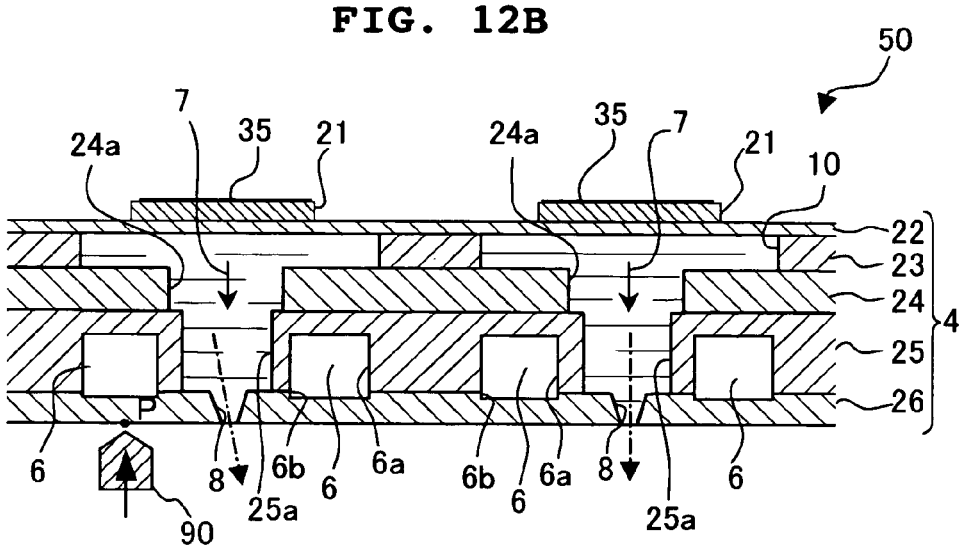
Figure 12C:
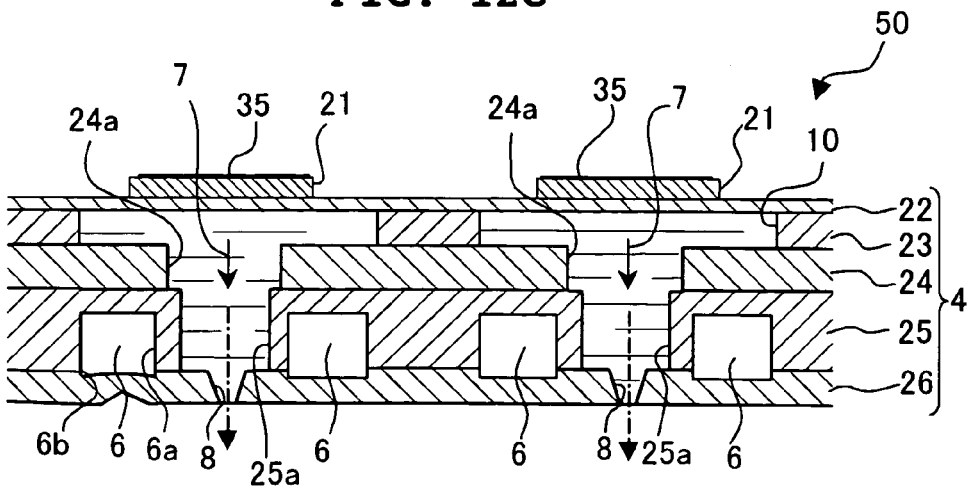

With reference to FIGS. 12A to 12C, a third embodiment of the present invention will be described below.

The structure of an ink jet head according to this embodiment is similar to that of the ink jet head 9 according to the first embodiment and will not be described. A method for correcting the direction in which ink is discharged from a nozzle 8 of the ink jet head according to the third embodiment differs from the correcting method for the first embodiment mainly as follows. The deforming step for the first embodiment involves radiating a laser beam to the radiation region in a less rigid region. The radiation region corresponds to the direction in which the ink discharged from a defective nozzle 8 deviates. The deforming step for the third embodiment involves pressing an indenting tool against a pressing point on a less rigid region. The pressing point corresponds to the direction in which the ink discharged from a defective nozzle 8 deviates. The other steps for this embodiment are similar to the counterparts for the first embodiment, which are shown in FIG. 7, and will not be described in detail.

As is the case with the first embodiment, a nozzle 8 is regarded as defective if the ink discharged therefrom deviates directionally beyond a specified amount, and if the directional deviation needs correcting. The procedure for correcting the direction in which ink is discharged from a nozzle of the ink jet head according to the third embodiment includes a detecting step for extracting the defective nozzles from nozzles 8 of the ink jet head and detecting the direction and amount in which the ink discharged from each extracted nozzle 18 deviates. This correcting procedure further includes a deforming step for deforming the vicinity of each defective nozzle 8 based on the detection results in the detecting step.

With reference to FIGS. 12A to 12C, the deforming step will be described below in detail. In FIG. 12A, the ink discharged from the left nozzle 8 deviates to the right from the direction perpendicular to the bottom surface of the nozzle plate 26. Therefore, as shown in FIG. 12B, an indenting tool 90 is pressed against a pressing point P on the bottom surface of the nozzle plate 26 in a less rigid region. In FIG. 12B, the pressing point P is located on the left side of the left nozzle 8, which is opposite to the direction in which the ink discharged from the nozzle 8 deviates. The load with which the indenting tool 90 is pressed is determined in accordance with the amount in which the ink discharged from the nozzle 8 deviates directionally. The indenting tool 90 can be pressed with various loads against various points, and it is possible to determine in advance how the discharge direction changes with them. The determined results is the basis for setting a pressing point and a pressing load according to the direction and amount of deviation. As shown in FIG. 12C, the pressing of the indenting tool 90 against the pressing point P deforms the vicinity of the left nozzle 8. The deformation corrects the left nozzle 8 so that the discharge direction is perpendicular to the bottom surface of the nozzle plate 26.

Thus, as is the case with the correcting methods for the first and second embodiments, the correcting method for the third embodiment makes it possible to improve the head production yield.

In the deforming step, the indenting tool 90 is pressed against the pressing point P to deform the less rigid region. This makes it possible to correct the discharge direction at low cost. The load with which the indenting tool 90 is pressed is determined in accordance with the amount in which the ink discharged from the nozzle 8 deviates directionally. This makes it possible to correct the directional deviation with high accuracy.

The ink jet head according to this embodiment has other advantages as the ink jet heads according to the first and second embodiments have.

The present invention is not limited to the preferred embodiments described hereinbefore, but various modifications may be made within the scope of the appended claims. The detecting step for detecting the directional deviation for each of the three embodiments includes the extracting step for extracting the defective nozzle or nozzles from the plurality of nozzles of the ink jet head. Alternatively, the detecting step may include no such extracting step.

The deforming step of each of the first and second embodiments involves irradiating a radiation region with a laser beam to deform a less rigid region. The deforming step of the third embodiment involves pressing an indenting tool against a pressing point to deform a less rigid region. The deforming steps might involve other methods for deforming less rigid regions. For example, a less rigid region might be deformed by spark forming, which is a method for partially heating a metallic material with sparks generated when an electrode is moved toward the material while voltage is applied to the material. This creates a great thermal stress in the metallic material due to partial thermal expansion of the material, so that the material deforms.

In each of the first and second embodiments, the intensity of the laser beam is constant, and the area of each radiation region is determined in accordance with the amount in which the ink discharged from the associated nozzle deviates directionally. Alternatively, the area of each radiation region may be constant, and the intensity of the laser beam may be determined in accordance with the amount of deviation. Alternatively, both the intensity of the laser beam and the area of each radiation region may be constant, and the radiation time may be determined in accordance with the amount of deviation.

In the third embodiment, the load with which the indenting tool is pressed is determined in accordance with the amount in which the ink discharged from a defective nozzle deviates directionally. Alternatively, the pressing load may be constant regardless of the amount of deviation, and the number of indenting tools to be pressed against the nozzle plate 26 may be determined in accordance with the amount of deviation. In a case that a plurality of indenting tools are used, the pressing points of the indenting tools may be positioned so that the center of gravity of these points can be aligned with a pressing point P.

In each of the three embodiments, the channel unit has a laminated structure in which five plates are laminated. The channel unit also has cavities formed therein, each by two grooves. One of the grooves is formed in the nozzle plate. The other groove is formed in the manifold plate which is bonded to the top surface of the nozzle plate. Alternatively, the cavities may be grooves formed in only one of the manifold plate and nozzle plate. The cavities may be formed in one or more of the plates other than the nozzle plate and manifold plate. The channel unit may not have a laminated structure.

In each of the three embodiments, the channel unit has annular cavities formed therein in the vicinity of the bottom surface of the nozzle plate (ink discharge surface), each around one of the nozzles. Alternatively, a plurality of cavities rectangular in plan view may be formed to disperse around each nozzle. The rectangular cavities may be in rotational symmetry around the nozzle. The cavities may not be limited to cubes or rectangular parallelepipeds, but may be spherical or three-dimensionally elliptic, or may have any other shapes.

In each of the three embodiments, the formation of each annular cavity results in a less rigid region being formed near the associated nozzle in the channel unit. The annular cavities may be filled with ink or another material having a lower coefficient of elasticity than the material or materials of the five plates of the channel unit. Alternatively, a portion of the channel unit that is near to each nozzle may be formed of a less rigid material so that a less rigid region can be formed near the nozzle in the unit.

Figure 13:
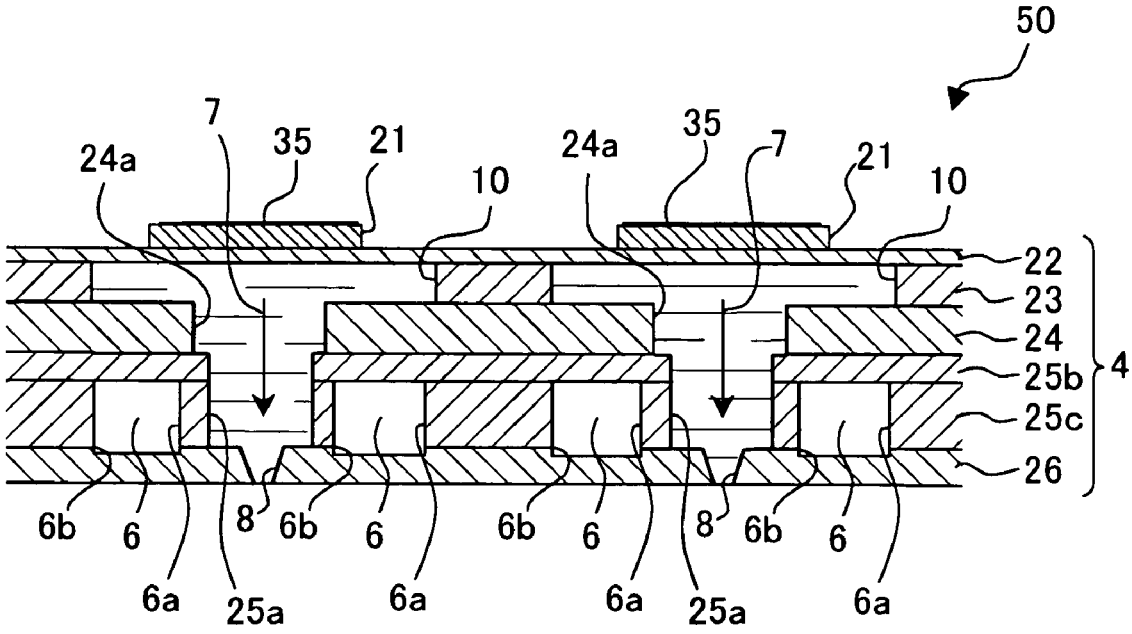
FIG. 13 shows a partial cross section of a head main body according to a modified embodiment of the embodiments of the present invention.

In each of the three embodiments, the manifold plate 25 is integrally formed. However, as shown in FIG. 13, the manifold plate may have a laminated structure formed by laminating a plurality of plates such as a flat plate 25*b* and a plate 25*c* having a through hole formed therein, and the present invention can be applied to an ink-jet head having such a manifold plate with the laminated structure.

The ink jet head according to each of the three embodiments is a piezoelectric ink jet head, but may be an ink jet head of the bubble jet (a registered trademark) type.

What is claimed is:

1. An ink jet head comprising:

a plurality of nozzles which discharge an ink and are formed through a nozzle plate formed of a metallic material; and a plurality of less rigid regions each of which is formed on the nozzle plate in the vicinity of one of the nozzles, has a rigidity lower than a periphery of each region, and is plastically deformable.

2. The ink jet head according to claim 1 having a structure formed by laminating a plurality of plates including:

the nozzle plate; and a second plate which adjoins the nozzle plate and has recesses formed therein as the less rigid regions.

3. The ink jet head according to claim 1 having a structure formed by laminating a plurality of plates including the nozzle plate, wherein at least the nozzle plate has recesses formed therein as the less rigid regions.

4. The ink jet head according to claim 1, wherein the less rigid regions are annular and each formed around one of the nozzles.

5. The ink jet head according to claim 1, wherein the less rigid regions include cavities or portions filled with material having a lower coefficient of elasticity.

6. An ink jet head having a structure formed by laminating a plurality of plates, comprising:

a nozzle plate through which the nozzles are formed; and a second plate which adjoins the nozzle plate and is formed of metallic material, wherein at least the nozzle plate is formed of material through which a laser beam is transmitted, and the second plate has a plurality of less rigid regions each of which is formed in the vicinity of one of the nozzles, has a rigidity lower than a periphery of each region, and is plastically deformable.

7. The ink jet head according to claim 6, wherein the material through which a laser beam is transmitted is transparent glass.

* * * * *